US005664375A

United States Patent [19]

Ward

[11] Patent Number: 5,664,375

[45] Date of Patent: Sep. 9, 1997

[54] EXTERIOR BUILDING PRODUCT DEVICE

[75] Inventor: John Frederick Ward, Midhurst, Canada

[73] Assignee: Canplas Industries, Ltd., Barrie, Canada

[21] Appl. No.: 630,557

[22] Filed: Apr. 10, 1996

Related U.S. Application Data

[63] Continuation of Ser. No. 228,617, Apr. 15, 1994, abandoned.

[51] Int. Cl.[6] ..... E04D 13/00

[52] U.S. Cl. ..... 52/97; 52/302.1; 52/473

[58] Field of Search ..... 52/97, 473, 211, 52/212, 302.1; 98/27, 116, 119, 121.1

[56] References Cited

U.S. PATENT DOCUMENTS

| | | | |
|---|---|---|---|
| Re. 17,164 | 12/1928 | Miller . | |
| 115,168 | 5/1871 | Congdon . | |
| 141,204 | 7/1873 | Campbell . | |
| 157,148 | 11/1874 | Bracher . | |
| 785,820 | 3/1905 | Miller, Jr. . | |
| 1,233,536 | 7/1917 | Adams . | |
| 1,340,673 | 5/1920 | Roe . | |
| 1,909,657 | 5/1933 | Burgin . | |
| 2,144,406 | 1/1939 | Gunter . | |
| 2,480,562 | 8/1949 | Ewing | 98/121 |

(List continued on next page.)

FOREIGN PATENT DOCUMENTS

| | | |
|---|---|---|
| 293 707 | 2/1971 | Austria . |
| 304 045 | 4/1972 | Austria . |
| 935021 | 10/1973 | Canada . |
| 1280024 | 2/1991 | Canada . |
| 1288856 | 9/1991 | Canada . |
| 1288273 | 9/1991 | Canada . |
| 2 233 482 | 1/1975 | France . |
| 2 564 519 | 11/1985 | France . |
| 2 590 621 | 5/1987 | France . |
| 589 983 | 3/1952 | Germany . |
| 2 219 821 | 12/1989 | United Kingdom . |

OTHER PUBLICATIONS

Abstract US 3,315,924 Greenwood.
Abstract US 4,156,272 Wandler.
Abstract US 4,245,284 Moore et al.
Abstract US 4,472,768 Quiogue.
Abstract US 4,635,168 Crowley.
Application CA 2,002,710.
Application CA 2,011,685.
Application CA 2,028,982.
Industrial Design CA 62,292.
Industrial Design CA 62,293.
Abstract US 5080005 Kolt.
Abstract US 5050489 Mankowski.
Abstract US 5022314 Waggoner.
Abstract US 5009149 McLeod.

(List continued on next page.)

*Primary Examiner*—Creighton Smith
*Attorney, Agent, or Firm*—Hoffmann & Baron

[57] ABSTRACT

An exterior ventilation device having a main body with an upstanding perimeter wall and an attachment flange extending outwardly from the upstanding perimeter wall. A plurality of louvers extend across the body adjacent to the other end of the perimeter wall each of the louvers being sloped downwardly and outwardly. A trim ring is attachable to the main body and defines a cavity between the attachment flange and the skirt of the trim ring into which siding may be inserted. The body is provided with a water directing rib to direct any water running down the body from the back of the body towards the front of the body and thus outside of any cladding material located in the cavity between the trim ring and the attachment flange. In one embodiment the water directing feature is a rib and in another embodiment the feature is a groove. In a further embodiment the body includes sloped portions of the perimeter wall and the water directing feature begins spaced apart from the attachment flange and not directly adjacent it.

20 Claims, 6 Drawing Sheets

U.S. PATENT DOCUMENTS

| | | | |
|---|---|---|---|
| 2,555,626 | 6/1951 | Avers et al. . | |
| 2,644,809 | 1/1953 | Morell . | |
| 2,752,844 | 7/1956 | Simblest | 98/121 |
| 2,754,747 | 7/1956 | Bertling | 98/106 |
| 2,855,841 | 10/1958 | Smith et al. . | |
| 3,103,710 | 9/1963 | Frederickson | 20/11 |
| 3,139,703 | 7/1964 | Hilt . | |
| 3,202,082 | 8/1965 | Viehmann | 98/88 |
| 3,220,079 | 11/1965 | Aggson | 25/118 |
| 3,387,552 | 6/1968 | Minds, Jr. | 98/121 |
| 3,422,744 | 1/1969 | Tarnoff . | |
| 3,500,600 | 3/1970 | Bagley, Sr. | 52/211 |
| 3,527,012 | 9/1970 | Hemminger . | |
| 3,577,864 | 5/1971 | Sommerfeld | 52/473 |
| 3,641,721 | 2/1972 | Martin | 52/212 |
| 3,680,471 | 8/1972 | Rosendale | 98/117 |
| 3,740,909 | 6/1973 | Stinnes . | |
| 3,886,703 | 6/1975 | Rousey | 52/473 |
| 3,943,679 | 3/1976 | Dissinger | 52/473 |
| 3,968,738 | 7/1976 | Matzke | 98/108 |
| 4,026,082 | 5/1977 | Crofoot | 52/302 |
| 4,103,468 | 8/1978 | Olsen | 52/473 |
| 4,389,824 | 6/1983 | Anderson | 52/211 |
| 4,407,100 | 10/1983 | Huelsekopf | 52/212 |
| 4,502,368 | 3/1985 | Hempel | 98/29 |
| 4,543,753 | 10/1985 | Sonneborn et al. . | |
| 4,587,892 | 5/1986 | Witten et al. | 98/29 |
| 4,592,271 | 6/1986 | Young | 98/114 |
| 4,621,466 | 11/1986 | Sonneborn et al. . | |
| 4,726,152 | 2/1988 | Vagedes et al. | 52/28 |
| 4,770,087 | 9/1988 | Danley et al. | 98/87 |
| 4,785,596 | 11/1988 | Wiley et al. | 52/302 |
| 4,875,317 | 10/1989 | Logan | 52/302.1 X |
| 4,875,318 | 10/1989 | MacLeod et al. | 52/211 |
| 4,892,322 | 1/1990 | Koza et al. | 277/207 |
| 4,899,647 | 2/1990 | Garries et al. | 98/121.1 |
| 4,911,066 | 3/1990 | Carew | 98/121.1 |
| 4,920,708 | 5/1990 | MacLeod et al. | 52/60 |
| 4,920,709 | 5/1990 | Garries et al. . | |
| 5,201,879 | 4/1993 | Steele . | |
| 5,303,522 | 4/1994 | Vagedes . | |

OTHER PUBLICATIONS

Abstract US 5007216 Pearson.
Abstract US 4942699 Spinelli.
Abstract US 4924761 MacLeod.
Abstract US 4796658 Caple.
Abstract US 4785596 Wiley.
Abstract US 4633768 Benson.
Abstract US 4593504 Bonnici.
Abstract US 4530170 Green.
Abstract US 4502368 Hempel.
Abstract US 4490952 Winston.
Abstract US 4406095 Slavik.
Abstract USD 303705 Benefield.

EXTERIOR BUILDING PRODUCT DEVICE

This application is a continuation of Ser. No. 08/228617 filed Apr. 15, 1994 now abandoned.

FIELD OF THE INVENTION

This invention relates generally to the building products field, and in particular to building products and devices of the type that may be used on the exterior of buildings to cover ventilation openings between interior spaces and the exterior for the purpose of providing ventilation or light.

BACKGROUND OF THE INVENTION

In modern construction it is common to provide ventilation of closed spaces to allow moisture and the like to be removed. For example, in many houses there is a space below the peak of the roof which is not finished, and is called an attic. To allow for moisture and the like to be removed from the space it is common to provide one or more ventilation holes into the attic space. To avoid problems with rain snow and the like getting in through such ventilation openings it is common to provide a cover or vent. Such vents are typically located below the eaves in the gable, and may be centered, for example below a peak in the roof.

Another trend in modern construction is to clad the exterior of a residential building with a durable low maintenance cladding material. Examples of this type of material are aluminum and vinyl siding. The siding is typically provided with alternating ridges and valleys and imitates the lapped appearance of the original wood type of siding. Of course aluminum and vinyl siding is also lapped, to prevent water running behind the siding and penetrating to the interior of the building, by being absorbed through the walls or the like.

Such cladding or siding is made by many different manufacturers and in many different styles and sizes. Openings in the siding, corresponding to the ventilation openings, for example in the gables, are necessary to allow for proper ventilation. To prevent water from entering the building, it is preferable to have the siding lap over top of the ventilation cover. However, such siding may be difficult to precisely trim by hand and there is typically a rough uneven edge left at the end adjacent to the opening. Therefore it is preferable to have a trim edge or ring on the ventilation cover to hide this rough edge.

Unfortunately, there is a problem when the trim cover overlies the siding. Due to the uneven nature of the outer surface of the siding, by reason of the alternating peaks and valleys, it can be difficult to form a good seal against the siding. Various attempts have been made to deal with this problem. For example, in Canadian patent 1,280,024 granted 1991/02/12 to Tapco Products Company, Inc. there is provided a two part plastic louver, which has an integral body, which covers the ventilation opening and has a peripheral attachment flange. A trim ring is attachable on the outside of the body. In use, the body is attached to the building wall, the siding is than laid up to the edge of the body, and the trim ring is placed on last to cover the rough edges of the siding. The trim ring and the body are provided with cooperating interengaging ribs to allow the trim ring to be positioned on the body at a number of different heights so in effect the trim ring can be closely positioned against the siding.

Due to the nature of the peaks and valleys of the siding, as previously noted, even though the trim ring of this prior device is closely positioned or pressed against the peaks of the siding, there are gaps associated with the valleys. This means that in practice the installer is required to caulk around the exterior of the trim ring to ensure a waterproof seal. This is a time consuming, awkward and messy job which is better avoided, if possible.

To overcome the problem of the gaps, it has also been proposed to provide a serrated edge on the trim ring. However, since each siding manufacturer makes different sizes of lap height, length and overlap in their siding, and since there is no telling where the ventilation opening is going to be located relative to the laps in the siding, a preformed serrated edge is not likely to fit. One prior art solution as shown in Canadian patent application 2,002,710 laid open 1991/05/10 in the name of Dean F. S. Carew is to make a mould of the exact profile of the siding to be covered and then form a custom fit trim ring. However, such custom fitting is simply too expensive and labour intensive to be practical on a mass production scale. Further even though this may make the sealing easier, it will still be necessary to seal the edge of the trim ring against water.

What is desired therefore is an exterior ventilation device which is simple to install and yet provides a good protection against water. Such a device should overcome the problems of the lapped cladding material without requiring an individual customization of either a serrated edge of the trim ring, or any post installation sealing or caulking.

SUMMARY OF THE INVENTION

Therefore according to the present invention there is provided a building product for the exterior of a building, said product comprising:

a main body having;

an upstanding perimeter wall, a top, a bottom, and generally opposed sides edges in plan view, an outer face and an inner edge in side view;

an attachment flange extending from at least a portion of said perimeter wall along said inner edge for attaching said main body to a surface;

a water directing means to direct any water running down said upstanding perimeter wall of said main body towards the front of said main body, and outside of any cladding located between the trim ring and the attachment flange; and a trim ring attachable to the main body and defining a cavity between the attachment flange and the trim ring into which cladding may be inserted.

BRIEF DESCRIPTION OF THE DRAWINGS

Reference will now be made to the following drawings, by way of example only, which illustrate preferred embodiments of the invention and in which.

DETAILED DESCRIPTION OF THE PREFERRED EMBODIMENTS

Figure 1:
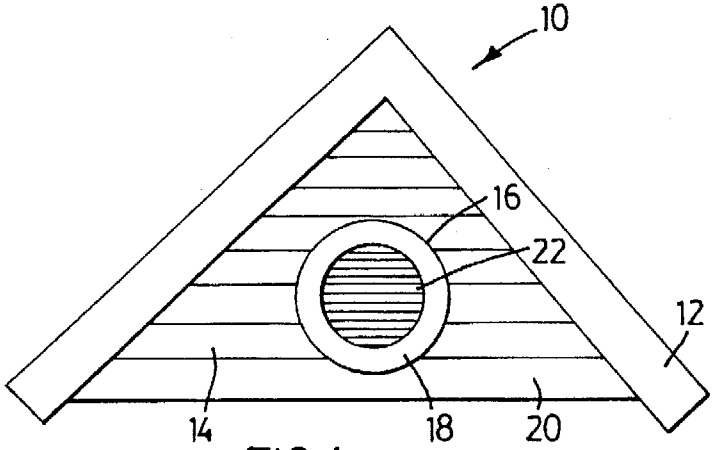
FIG. 1 is a side view of a building showing an exterior according to the present invention.

FIG. 1 shows a peaked roof, generally indicated as 10, having eaves 12, and a gable or end wall 14. Located on the gable 14 is an exterior building product, such as for example a, indicated as 16. A trim ring 18 is shown, which overlies siding 20, together with a middle louvered portion 22, which is described in more detail below.

Figure 2:
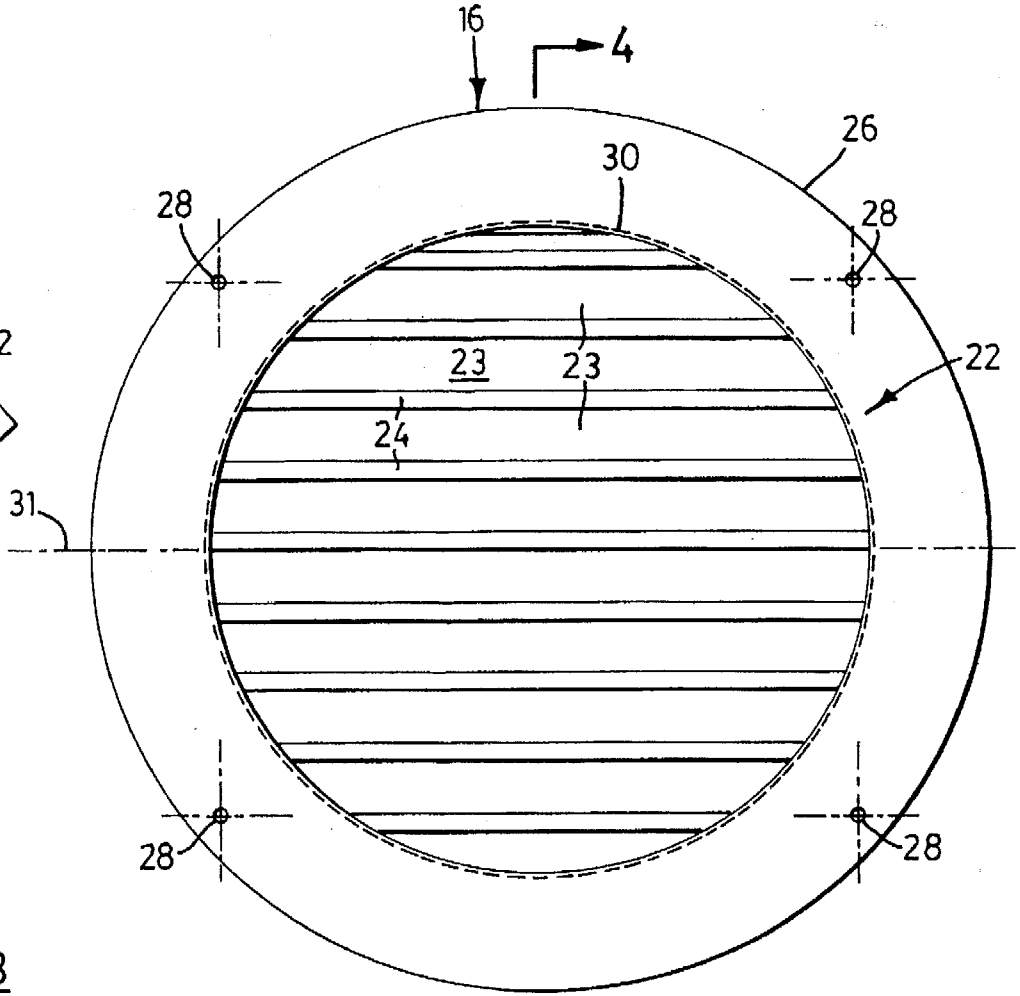
FIG. 2 is a close up side view of the exterior of claim 1.

FIG. 2 shows an enlarged version of the exterior of FIG. 1, without the trim ring 18. As can be seen, the middle louvered portion 22 comprises a plurality of generally horizontal louvers 23, angled downwardly and frontwardly for deflecting rain and the like from entering the building through a ventilation opening located behind the device 16. To maximize the water deflecting capabilities of the device 16, it is preferred to form them with at least a portion of the front face vertical, as shown at 24. An attachment flange 26 is shown around the middle portion 22 which includes fastener holes 28. The holes 28 are preferably slightly elongated, to allow for contraction and expansion of the body which occurs by reason of changes in temperature. The elongation preferably lies generally along a plane passing through the middle portion 22 of the body. Although four such holes are shown, it will be appreciated that more or fewer could be used, provided that the attachment to the building is secure enough to resist wind and snow loads. Also shown in dotted outline is a stop means 30, which is described in more detail below. A centre line 31 is also shown.

Figure 3:
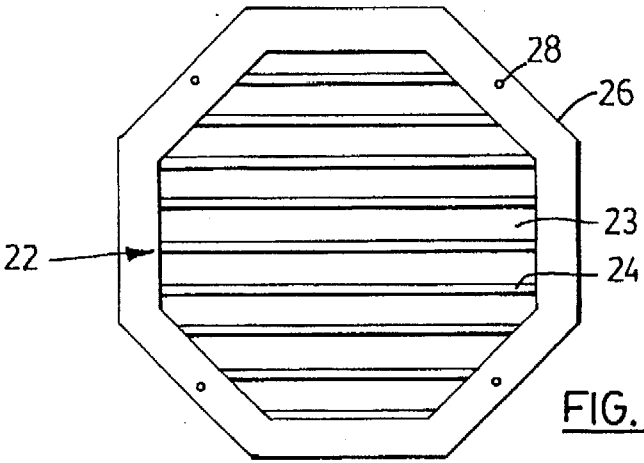
FIG. 3 is a second embodiment of the exterior of claim 2.

FIG. 3 shows a second embodiment of the device 16 which is octagonal, rather than being round as in FIG. 2. Again the trim ring 18 has been removed. It will be appreciated by those skilled in the art that the outer shape of the device 16 can be varied to suit architectural preference and could include, regular or even irregular polygons, half moon shapes, or other shapes if the same were desired. While reference is made herein to primarily a circular, in front view, device 16, the present invention comprehends many different shapes.

Figure 4:
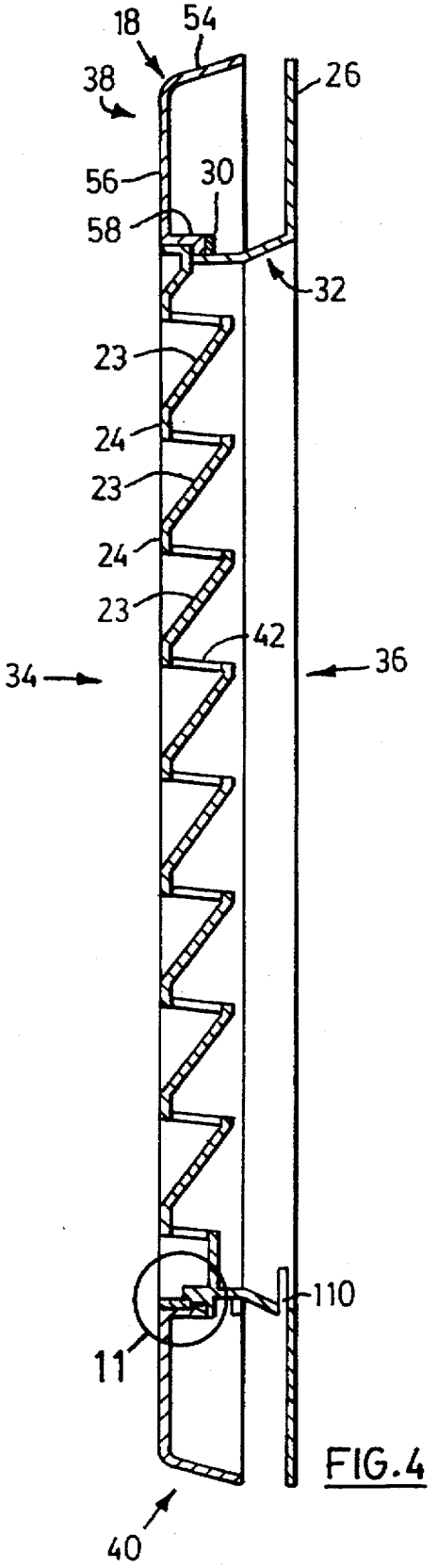
FIG. 4 is a cross sectional view along the lines 4—4 of FIG. 2.

FIG. 4 shows a side view in section along the line 4—4 in FIG. 2, with the addition of the trim ring 18. The vertical sections 24 are now more clearly seen, along with the slanted louvers 23. Also shown are the attachment flange 26, at the top and bottom of the figure. In the most preferred embodiment the attachment flange 26 extends outwardly for the full perimeter of the device 16 as shown in FIG. 2. It will be appreciated that the attachment flange is preferably made continuous about the perimeter for strength and water proofing reasons. However, in the present design a continuous attachment flange is not essential and some portion of it, especially along the lower half of the device 16 could perhaps be eliminated.

FIG. 4 also shows an upstanding wall 32 which carries the stop means 30. It will be appreciated that the device 16 has an outside face 34, and an inside face 36, as well as a top portion 38 and a bottom portion 40.

Figure 10:
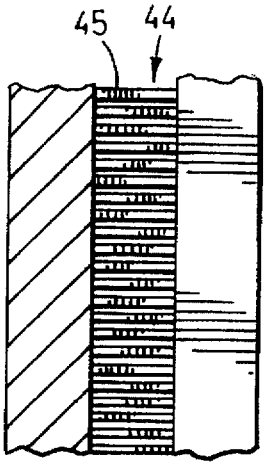
FIG. 10 is a top view along lines 10—10 of FIG. 9.

A screened portion 42 is also shown between the top of each louver 23 and the adjacent vertical section 24. This screened portion is preferably moulded integral with the main body or louvered middle portion 22. FIG. 10 shows this in top view, and as can be seen the screened portion 42 comprises a plurality of individual bars or slats 44 close spaced together. The slats 44 permit air passage through the device 16 through the openings 45, but generally prevent the ingress of unwanted things such as bugs, pests and even rain and snow to a certain extent. The formation of the slats at this location, is an improvement over the prior art attachment of a thin mesh screen to the back of the device, since the slats 44 prevent things from getting behind the louvers as is possible in the prior designs. The preferred size of the slats is 1 inch long, by 0.075 inches thick by 0.10 inches deep. The preferred spacing is in the range of 0.05 to 0.15 inches, inside edge to inside edge, but it will be appreciated that this can vary to suit local building code requirements and the like. What is desired is to prevent pests from entering, without impeding free and easy air flow.

Figure 5:
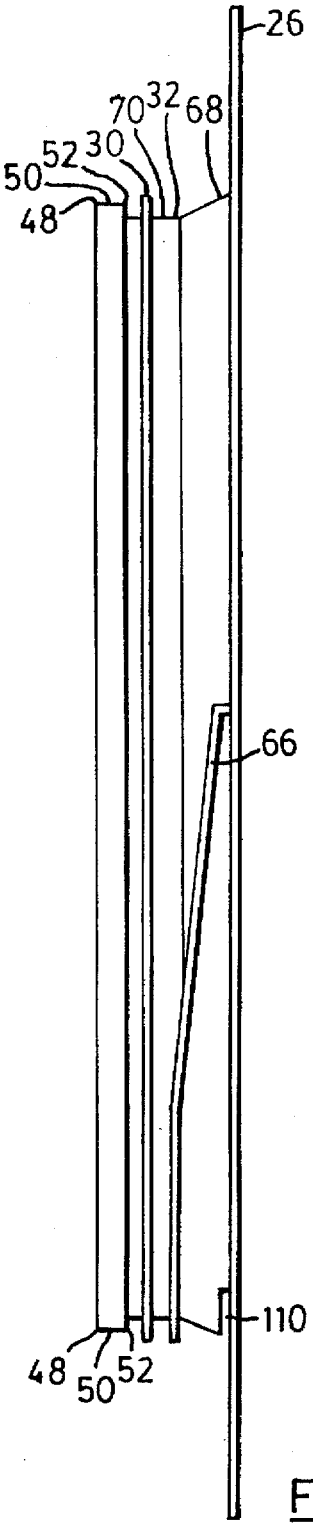
FIG. 5 is a side view of the exterior of FIG. 2 without a trim ring.

FIG. 5 shows the device 16 in side view, without the trim ring 18. As can be seen there is an engagement lip 46, which in the preferred embodiment runs around the perimeter of the middle portion 22. The engagement lip is defined by an outside corner 48, a side edge 50 an inside corner 52. The stop 30 is also shown, and is in the form of a generally rectangular rib, standing out from the upstanding wall 32. Returning to FIG. 4, the trim ring is shown having a skirt portion 54, an outwardly facing ring 56 and a catch ring 58. The catch ring 58 includes a catch lip 60 and an abutting portion 62.

Figure 11:
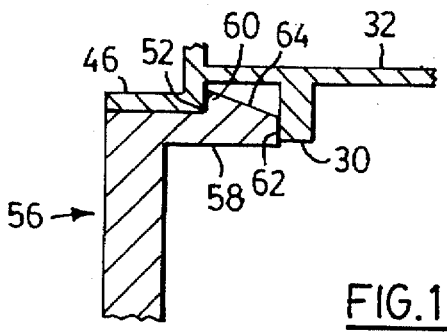
FIG. 11 is a close up view of the circle 11 of FIG. 9.

It can now be appreciated how the trim ring 18 may be easily and quickly attached to the middle portion 22. Referring to FIG. 11, which is a close up of the circle 11 of FIG. 4, it can be seen how the catch lip 60 fits over and is retained by the inside corner 52 of the engagement lip 46. Preferably the abutting portion 62 of the catch ring 58 is dimensioned to be against the stop 30, when the catch lip 60 clears the inside corner 52. Thus when the trim ring 18 is to be mounted on the middle portion 22, at the top edge the catch lip 60 is placed behind the inside corner 52 and the remainder of the catch lip 60 is worked over the engagement lip 46. To facilitate the ease of use, a cam surface 64 can be formed on the catch ring 58 as shown, especially around the lower half of the same.

Figure 6:
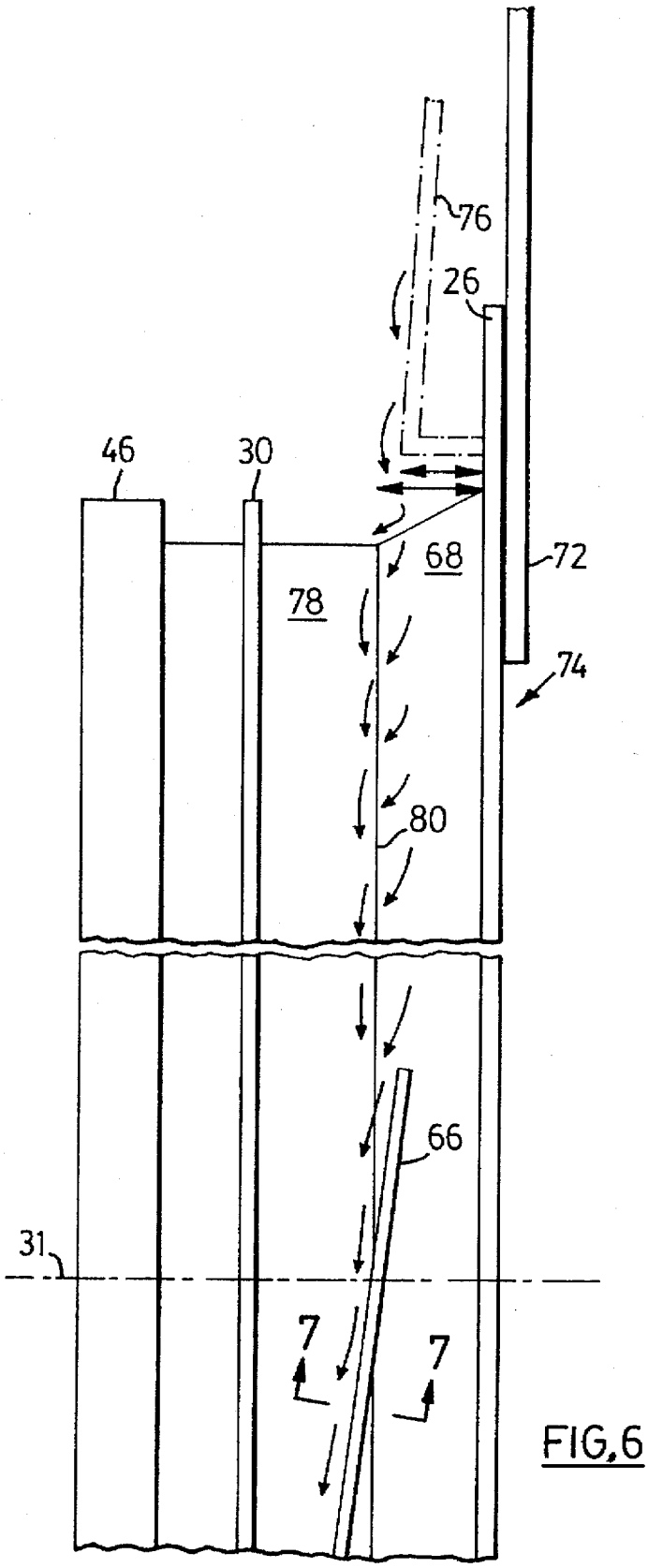
FIG. 6 is an enlarged view of portions of FIG. 5.
Figure 9:
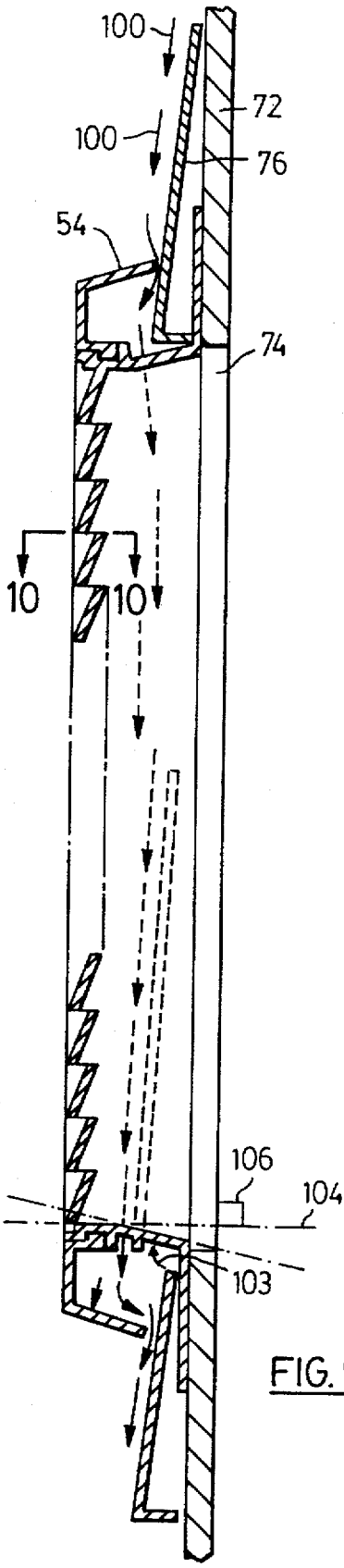
FIG. 9 is a side view of an exterior installed on a building with the trim ring in place.

FIG. 5 also shows a water guiding means which takes the form of a rib 66. It will also be noted that the upstanding side wall 32 includes a sloped portion 68 and a portion 70 which is generally perpendicular to the attachment flange 26. The sloped portion may extend only part way out from the attachment flange as shown in FIG. 6, or it may extend out the full length of the upstanding perimeter wall 32 as shown in FIG. 9. In either case the preferred form of the sloped portion 68 is a portion of a cone, so that the device 16 is symmetrical about is centre (in front view). The purpose of the sloped portion 68 is to direct water outwardly from the attachment flange and the siding or cladding. The present invention comprehends changing the slope of the sloped portion 68 to cause the water to be directed outwardly be reversing the slope on the lower half of the device 16. However this is not preferred because of the difficulty of moulding and the odd unsymmetrical appearance of the end product.

FIG. 6 shows the top portion of the device according to the present invention in the installed position. A wall is shown as 72, having a ventilation opening shown as 74. The top side of the attachment flange 26 is also shown and has been nailed or the like to the wall 72. A cladding material, such as siding, is shown in dotted outline at 76. The arrows 78 represent water making its way down the siding, dripping onto the sloped portion 68 of the upstanding wall, and then following the interface 80 between the sloped portion 68 and the generally perpendicular section 70 around the outside of the middle portion of the device 16. Also shown is the stop 30 and the catch ring 46.

As shown in FIG. 6, the water directing rib 66 preferably begins above the centre line 31, and is spaced somewhat away from the attachment flange 26. This is to prevent the rib from being an obstruction to the close fitting of siding 76 over the attachment flange 26. It will be appreciated that this is made possible by the sloped portion 68, which in the top half of the device 16 directs water outwardly and away from the attachment flange.

Figure 7A:
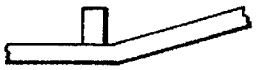
FIG. 7A is a side view along line 7—7 of FIG. 6.
Figure 7B:
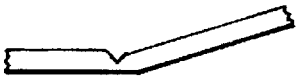
FIG. 7B is a side view along line 7—7 of FIG. 6 showing an alternate embodiment.

A cross section along the lines 7—7 is shown in FIG. 7A. In the preferred embodiment this in the form of a generally rectangular rib, but any surface feature which guides the water in the preferred direction would also be suitable. For example, in FIG. 7B there is shown a groove 66' which could be used in place of the rib 66. Depending upon the shape of the groove, the strength of the plastic and the like it may be preferred to use a plurality of grooves. This and other alternatives are comprehended by this invention, although the exact sizing of the grooves and their spacing must be such as to promote the desired water directing and shedding as outlined more fully below.

Figure 8:
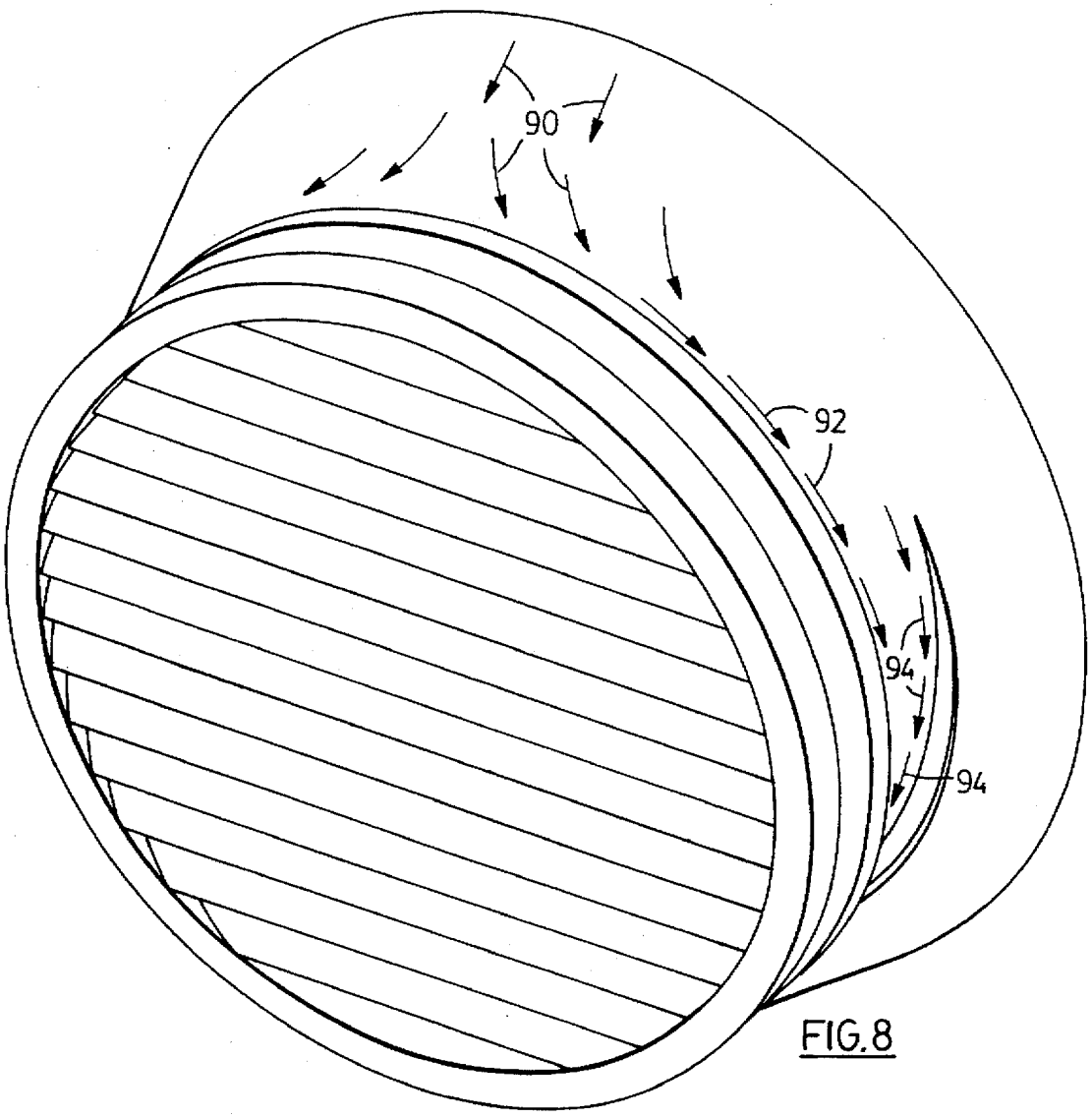
FIG. 8 is a perspective view of the exterior of FIG. 2 with the trim ring removed.

FIG. 8 shows a perspective view of the device 16, and shows by means of arrows the path of any water which may drip onto the middle portion 22. The arrows denoted as 90 show the water on the top side of the middle portion 22 being directed away from the attachment flange by reason of the sloped upstanding wall portion 68. The arrows noted as 92 show the water following along the upstanding wall portion, seeking the lowest level, which is of course down the sides of the device 16. The arrows 94 show the water being gathered by the water directing means such as the rib 66 which overcomes the natural tendency of the water to flow back towards the attachment flange below the centre line 31 of the device 16 because of the change of slope of the sloped portion 68 which follows the surface of a part cone.

FIG. 9 shows a second embodiment of the device, in which the louvers do not include vertical portions 24. In this view though both the top 38 and the bottom 40 are shown. As can be seen by the arrows 100, the water flows down the siding and drips onto the sloped surface 68. At this point the water is behind the skirt 54 of the trim ring since unlike the prior art the skirt is not sealed against the siding. The primary function of the trim ring is to cover the rough cut edge of the cladding, such as siding 76, which overlies the attachment flange. Also while the water can get in behind the skirt at the top 38 of the device, it can also get out from behind at the bottom 40. As shown by the arrows 102, at the bottom 40 the water will tend to fall off the rib 66 and land on the inside of the skirt 54. The skirt 54 is outside of the siding 76 at the bottom, and therefore the water will be shed onto the outside of the siding 76.

As can be seen, the sloped portion 68 forms an angle relative to the attachment flange 103. Angle 103 is preferably greater than 90 degrees. Also a projection line 104 of the portion 70 intersects the plane of the attachment flange at approximately 90 degrees as shown at 106.

Figure 12:
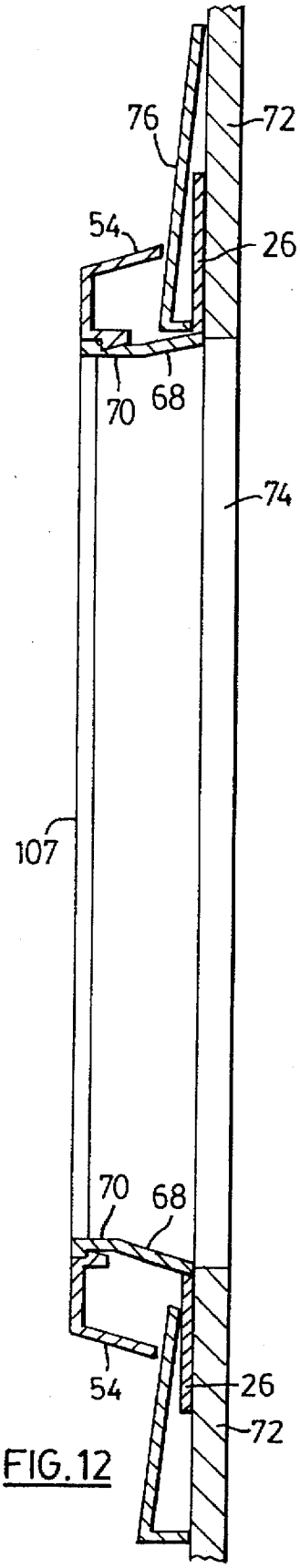
FIG. 12 is a side view of a further embodiment of the invention.

FIG. 12 shows a further embodiment of the present invention, in which the exterior building product is not a but is more of a window type of device. In this embodiment the louvers on the open or outside face are replaced with a light transmitting panel 107 such as transparent or translucent acrylic plastic. This allows the exterior device to act as a decorative architectural detail, and to allow light to be brought into, for example, garages or the like. Even though the outside face is different, in all other respects the embodiment of FIG. 12 is identical, in that it has a trim ring and a water directing means to ensure water is diverted outside of the siding or cladding.

It can now be appreciated how the present invention solves the problems of the prior art. Rather than trying to seal the skirt of the trim ring or cover against the peaks and valleys of the siding, the present invention recognises that water will get behind the skirt of the trim ring and instead makes sure that any such water that does get behind is directed or channelled to the outside of the siding at the point it drips off the device. This can be by being directed onto the back or inside of the trim ring, or can be by being allowed to drip directly off the body, but outside the siding.

Returning to FIG. 4, although the louvers 23 and the vertical sections 24 and the slats 45 in combination are designed to reduce the likelihood of water penetrating through the device, there is still a risk that drifting snow or a gust of wind carrying rain will cause some moisture to get past these obstacles and result in water on the inside of the device. As the lower portion of the part conical middle portion will tend to carry any such water into contact with the building a small drainage channel or cut is made at the lower perimeter as shown by 110 in FIG. 4. It will be appreciated that any water that does get this far will be behind the siding and in contact with the wall, but because this is such a small amount, it is not perceived as a problem. The drainage cut 110 ensures that the water or moisture does not end up sitting against the wall creating an opportunity for rot, decay or mould to set in. It will be apparent that a narrow width of the cut is preferable so that no bugs or pests can penetrate the device.

It can now be appreciated how the present invention may be installed. First, a ventilation opening may be cut in the exterior wall of a building. Then, the attachment flange may be secured around the opening by appropriate screws, nails or other fasteners, through holes 28. Then siding may be laid over the exterior of the building, and lapped over the attachment flange 26. Then, in one step, which is easily executed even on top of a ladder, the trim ring is hung off the top of the device, behind the catch lip, and pressed into engagement with the main body around the perimeter edge. In this one step easy manner, the installation of the device is completed.

It will also be appreciated by those skilled in the art that it is preferable to mold the exterior as a two piece unit. Each piece, namely the main body or middle portion 22 and the trim ring are preferably each integrally molded. The preferred material is an easily moldable plastic which has good weather resistant properties, and good colour retention. Satisfactory results have been achieved with easily molded plastics material, polypropylene, polystyrene, or the like.

It will be appreciated that the foregoing description is in respect of preferred embodiments of the invention. Other variations are contemplated by the broad scope of the attached claims some of which have been discussed and others of which shall be apparent to those skilled in the art. For example while reference has been made to a water directing rib, other possibilities are available such as a groove. Also the instant invention is applicable to many shapes and styles of louver or ventilation cover openings.

For example, the main body, rather than having a louvered opening, may be covered by a clear or translucent panel, and thus act to allow light into an interior space, such as garages or the like.

I claim:

1. A building product for an exterior portion of a building that is to be covered with cladding, said product comprising:

a trim ring; and a main body attached to said trim ring, said main body having:

a front;

an upstanding perimeter wall having a substantially continuous outside surface with an outward slope;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring for the insertion of said cladding inserted; and a water directing means comprising a surface feature which cooperates with said slope and is formed in said substantially continuous outside surface of said perimeter wall, said water directing means being sized and shaped to direct and guide water running down said substantially continuous outside surface of said upstanding perimeter wall of said main body along said substantially continuous outside surface towards the front of said main body, away from said surface of said building, and outside of any of said cladding located between the trim ring and the attachment flange.

2. An exterior building product as claimed in claim 1, wherein said building product is a ventilation device and wherein said outer face comprises a plurality of louvers extending across said body adjacent to an outer end of said perimeter wall, each of said louvers being sloped outwardly and downwardly, and wherein said main body has a top and a bottom and said water directing means comprises a surface feature which directs any water which may drip onto said main body, towards an outer edge of said main body as said water runs down towards the bottom of said main body.

3. A building product for an exterior portion of a building that is to be covered with cladding, said product comprising:

a trim ring: and a main body attached to said trim ring, said main body having:

a front;

an upstanding perimeter wall having a substantially continuous outside surface;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring for the insertion of said cladding; and a water directing means formed in said substantially continuous outside surface of said perimeter wall, said water directing means being sized and shaped to direct and guide water running down said substantially continuous outside surface of said upstanding perimeter wall of said main body towards the front of said main body, away from said surface of said building, and outside of any of said cladding located between the trim ring and the attachment flange;

wherein:

said building product is a ventilation device;

said outer face comprises a plurality of louvers extending across said body adjacent to an outer end of said perimeter wall, each of said louvers being sloped outwardly and downwardly;

said main body has a top and a bottom and said water directing means comprises a surface feature which directs any water which may drip onto said main body, towards an outer edge of said main body as said water runs down towards the bottom of said main body; and said surface feature comprises at least one rib, standing proud of said upstanding perimeter wall.

4. An exterior building product as claimed in claim 3 wherein said upstanding wall is comprised of at least in part an angled wall section wherein the angled wall section at the top of the main body forms an angle greater than ninety degrees in cross section relative to the attachment flange.

5. An exterior building product as claimed in claim 4 wherein the angled wall section is adjacent to the attachment flange.

6. An exterior building product as claimed in claim 3, wherein said rib, standing proud of said upstanding perimeter wall, does not touch any other surface of said building or said main body of said building product.

7. A building product for an exterior portion of a building that is to be covered with cladding, said product comprising:

a trim ring; and a main body attached to said trim ring, said main body having:

a front;

an upstanding perimeter wall having a substantially continuous outside surface;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring into for the insertion of said cladding; and a water directing means formed in said substantially continuous outside surface of said perimeter wall, said water directing means being sized and shaped to direct and guide water running down said substantially continuous outside surface of said upstanding perimeter wall of said main body towards the front of said main body, away from said surface of said building, and outside of any of said cladding located between the trim ring and the attachment flange;

wherein:

said building product is a ventilation device;

said outer face comprises a plurality of louvers extending across said body adjacent to an outer end of said perimeter wall, each of said louvers being sloped outwardly and downwardly;

said main body has a top and a bottom and said water directing means comprises a surface feature which directs any water which may drip onto said main body, towards an outer edge of said main body as said water runs down towards the bottom of said main body; and said surface feature comprises at least one groove, recessed into said upstanding perimeter wall to promote water migration to a front of said device.

8. An exterior building product as claimed in claim 3 or 7 wherein there are two of said surface features formed generally symmetrically on opposed sides of said main body.

9. An exterior building product as claimed in claim 7 wherein said upstanding wall is comprised of at least in part an angled wall section wherein the angled wall section at the top of the main body forms an angle greater than ninety degrees in cross section relative to the attachment flange.

10. An exterior building product as claimed in claim 9 wherein the angled wall section is adjacent to the attachment flange.

11. A building product for an exterior portion of a building that is to be covered with cladding, said product comprising:

a trim ring; and a main body attached to said trim ring, said main body having:

a front;

an upstanding perimeter wall having a substantially continuous outside surface;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring for the insertion of said cladding; and a water directing means formed in said substantially continuous outside surface of said perimeter wall, said water directing means being sized and shaped to direct and guide water running down said substantially continuous outside surface of said upstanding perimeter wall of said main body towards the front of said main body, away from said surface of said building, and outside of any of said cladding located between the trim ring and the attachment flange;

wherein the upstanding perimeter wall comprises two portions, an angled section adjacent to the attachment flange and in cross section forming an angle of greater than ninety degrees relative to said attachment flange and a straight walled section adjacent to the outer face of the main body, forming, in cross section, an angle of about ninety degrees at an intersection of projection lines from the attachment flange and the straight walled section.

12. A building product for an exterior portion of a building that is to be covered with cladding, said product comprising:

a trim ring; and a main body configured for attachment of said trim ring, said main body having:

a front;

an upstanding perimeter wall having a substantially continuous outside surface;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring into which said cladding may be inserted; and a water directing means formed in said substantially continuous outside surface of said perimeter wall, said water directing means being sized and shaped to direct and guide water running down said substantially continuous outside surface of said upstanding perimeter wall of said main body towards the front of said main body, away from said surface of said building, and outside of any of said cladding located between the trim ring and the attachment flange;

wherein said water directing means is a rib which does not extend fully to said attachment flange to reduce the likelihood of the rib interfering with the fitting of said cladding adjacent to the upstanding perimeter wall.

13. An exterior building product as claimed in claim 12 wherein said upstanding perimeter wall is comprised of at least in part, an angled wall section wherein the angled wall section at the top of the main body forms an angle greater than ninety degrees in cross section relative to the attachment flange and said water directing means comprises a rib which has a top end and a bottom end, wherein the top end is located on the angled wall section at a location where said angled wall section is directing water towards said outer face of said main body.

14. An exterior building product as claimed in claim 13 wherein said trim ring comprises an inner face ending at a inner edge, said inner edge being outside of said cladding in an installed position, and an outer face, and wherein said bottom of said rib is located towards a bottom of said main body and outwardly of said inner edge of said trim ring whereby water dripping off of said rib will drip outside of said cladding.

15. An exterior building product as claimed in claim 14 wherein said trim ring includes a face section, extending the outer face of the trim ring and a skirt section angled towards the attachment flange, and wherein water dripping onto said trim ring drips onto an inside of said skirt section and then off said trim ring at an inner edge.

16. An exterior building product as claimed in claim 13 wherein said angled wall section extends from said top of said body along said main body to at least a point on said sides of said body wherein said sides are generally vertical.

17. An exterior building product as claimed in claim 13 wherein said bottom end of said rib is located towards the bottom of said main body.

18. A building product for an exterior portion of a building that is to be covered with cladding, said product comprising:

a trim ring; and a main body attached to said trim ring, said main body having:

a front;

an upstanding perimeter wall having a substantially continuous outside surface;

a top, a bottom, and generally opposed side edges in plan view;

an outer face and an inner edge in side view;

an attachment flange extending from at least a portion of said perimeter wall along said inner edge for attaching said main body to a surface of said building, said attachment flange and said trim ring defining a cavity between said flange and said ring for the insertion of said cladding; and a water directing means formed in said substantially continuous outside surface of said perimeter wall, said water directing means being sized and shaped to direct and guide water running down said substantially continuous outside surface of said upstanding perimeter wall of said main body towards the front of said main body, away from said surface of said building, and outside of any of said cladding located between the trim ring and the attachment flange;

wherein said outer face comprises a light transmitting panel.

19. An exterior building product as claimed in claim 18, wherein said water directing means comprises a surface feature which directs water which may drip onto said main body towards an outer edge of said main body as said water runs down same main body.

20. An exterior building product as claimed in claim 18, where said water directing means comprises at least one groove recessed into said perimeter wall to promote water migration to a front of said device.

* * * * *